US008740374B2

(12) United States Patent
Seno et al.

(10) Patent No.: US 8,740,374 B2
(45) Date of Patent: Jun. 3, 2014

(54) INK JET RECORDING METHOD, INK JET RECORDING APPARATUS, AND INK JET RECORDED MATTER

(75) Inventors: Shin-ya Seno, Kanagawa (JP); Tamotsu Aruga, Saitama (JP); Masayuki Koyano, Kanagawa (JP); Eiji Noda, Kanagawa (JP); Norlyasu Takeuchi, Kanagawa (JP); Okitoshi Kimura, Kanagawa (JP); Tsutomu Maekawa, Kanagawa (JP); Takao Hiraoka, Kanagawa (JP); Soh Noguchi, Kanagawa (JP); Tomoko Hasegawa, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 135 days.

(21) Appl. No.: 13/427,174

(22) Filed: Mar. 22, 2012

(65) Prior Publication Data

US 2012/0242768 A1 Sep. 27, 2012

(30) Foreign Application Priority Data

Mar. 25, 2011 (JP) ..... 2011-067081

(51) Int. Cl.
*B41J 2/01* (2006.01)

(52) U.S. Cl.
USPC ..... 347/102

(58) Field of Classification Search
USPC ..... 347/95, 96, 100–103
IPC ..... B41J 2/01
See application file for complete search history.

(56) References Cited

U.S. PATENT DOCUMENTS

| | | | |
|---|---|---|---|
| 4,554,555 | A | 11/1985 | Aruga et al. |
| 4,581,071 | A | 4/1986 | Akutsu et al. |
| 4,620,876 | A | 11/1986 | Fujii et al. |
| 4,631,085 | A | 12/1986 | Kawanishi et al. |
| 4,647,310 | A | 3/1987 | Shimada et al. |
| 4,711,668 | A | 12/1987 | Shimada et al. |
| 4,713,113 | A | 12/1987 | Shimada et al. |
| 4,737,190 | A | 4/1988 | Shimada et al. |
| 4,793,860 | A | 12/1988 | Murakami et al. |
| 5,622,550 | A | 4/1997 | Konishi et al. |
| 5,810,915 | A | 9/1998 | Nagai et al. |
| 5,879,439 | A | 3/1999 | Nagai et al. |
| 5,882,390 | A | 3/1999 | Nagai et al. |
| 5,972,082 | A | 10/1999 | Koyano et al. |
| 5,993,524 | A | 11/1999 | Nagai et al. |

(Continued)

FOREIGN PATENT DOCUMENTS

| | | |
|---|---|---|
| JP | 2004-42525 | 2/2004 |
| JP | 2004-42548 | 2/2004 |

(Continued)

*Primary Examiner* — Manish S Shah
*Assistant Examiner* — Roger W Pisha, II
(74) *Attorney, Agent, or Firm* — Oblon, Spivak, McClelland, Maier & Neustadt, L.L.P.

(57) ABSTRACT

An ink jet recording method including: applying at least two energy beam curable liquids different from each other in surface tension on a recording medium to form an energy beam curable liquid layer having a distribution pattern of different surface tensions; ejecting an energy beam curable ink on the energy beam curable liquid layer formed on the recording medium; and irradiating the energy beam curable liquid layer and the energy beam curable ink with energy beams to cure the energy beam curable liquid layer and the energy beam curable ink to form an image.

13 Claims, 8 Drawing Sheets

(56) References Cited

U.S. PATENT DOCUMENTS

| | | | |
|---|---|---|---|
| 6,106,602 | A | 8/2000 | Ouchi et al. |
| 6,120,589 | A | 9/2000 | Bannai et al. |
| 6,231,652 | B1 | 5/2001 | Koyano et al. |
| 6,261,349 | B1 | 7/2001 | Nagai et al. |
| 6,613,136 | B1 | 9/2003 | Arita et al. |
| 6,688,737 | B2 | 2/2004 | Nagai et al. |
| 6,695,443 | B2 | 2/2004 | Arita et al. |
| 6,730,155 | B2 | 5/2004 | Gotoh et al. |
| 6,786,588 | B2 | 9/2004 | Koyano et al. |
| 6,799,845 | B2 | 10/2004 | Kaneko et al. |
| 7,033,013 | B2 | 4/2006 | Koyano et al. |
| 7,919,544 | B2 | 4/2011 | Matsuyama et al. |
| 7,950,793 | B2 | 5/2011 | Aruga et al. |
| 8,044,114 | B2 | 10/2011 | Habashi et al. |
| 8,118,419 | B2 | 2/2012 | Morohoshi et al. |
| 2007/0197685 | A1 | 8/2007 | Aruga et al. |
| 2008/0199631 | A1 | 8/2008 | Makuta et al. |
| 2008/0311299 | A1 | 12/2008 | Furukawa |
| 2009/0085996 | A1* | 4/2009 | Kasai ..... 347/100 |
| 2009/0085999 | A1* | 4/2009 | Furukawa ..... 347/102 |
| 2009/0162569 | A1 | 6/2009 | Morohoshi et al. |
| 2009/0186162 | A1 | 7/2009 | Namba et al. |
| 2009/0233061 | A1* | 9/2009 | Irita ..... 428/195.1 |
| 2010/0196601 | A1 | 8/2010 | Goto et al. |
| 2010/0196602 | A1 | 8/2010 | Koyano et al. |
| 2011/0057981 | A1 | 3/2011 | Aruga et al. |
| 2011/0060100 | A1 | 3/2011 | Kimura et al. |
| 2011/0298876 | A1 | 12/2011 | Takeuchi et al. |

FOREIGN PATENT DOCUMENTS

| | | |
|---|---|---|
| JP | 2004-244624 | 9/2004 |
| JP | 2007-83611 | 4/2007 |
| JP | 2008-105382 | 5/2008 |
| JP | 4157336 | 7/2008 |
| JP | 2008-221824 | 9/2008 |
| JP | 2008-246837 | 10/2008 |

* cited by examiner

INK JET RECORDING METHOD, INK JET RECORDING APPARATUS, AND INK JET RECORDED MATTER

BACKGROUND OF THE INVENTION

1. Field of the Invention

The present invention relates to an improved ink jet recording method applicable, for example, to printers using ink jet methods, high-speed business printers, apparatuses for printing on plastic films, and label printing apparatuses, an ink jet recording apparatus, and an ink jet recorded matter.

2. Description of the Related Art

Ink jet recording technology is a technique that brings ink to liquid droplets through micronozzles using a pressure on-demand method, a charge control method and the like and deposits the liquid droplets on a recording medium such as paper according to image information. The ink jet recording technology is suitable for use in image forming apparatuses such as printers, facsimile machines, and copying apparatuses. According to the ink jet recording technology, ink is deposited directly on a recording medium to form an image, and, thus, recording can be performed in a simpler apparatus construction than in indirect recording using photoreceptors such as electrophotographic recording. This would lead to further development of the ink jet technology as a method for recording image on recording media in the future.

The ink jet recording method is a low-noise printing method, and a method (a direct ejection method) is mainly used that directly ejects ink on recording media such as papers, cloths, and plastic sheets according to image signals to print characters, images and the like. Further, in the ink jet recording method, any plate is not necessary in printing. Accordingly, printed matters can be efficiently prepared even when the number of printed matters is small. Thus, the ink jet recording method is also expected in industrial applications. When the ink jet recording method is used in industrial applications, images should be formed on various recording media. The direct ejection method that is mainly used cannot satisfy this point.

Specifically, in the ink jet recording method by the direct ejection method, there is a limitation that the method is likely to be influenced by recording media.

More specifically, due to a difference in ink absorption and in wettability by ink between recording media, way of spreading, way of feathering or bleeding, and way of connection to adjacent dots vary. Accordingly, the image quality is likely to be influenced by recording media, and, thus, it is difficult to form stable images on various recording media. For example, for ink-absorptive recording media such as papers, ink droplets are deposited on an ink-absorptive recording medium such as paper and are permeated into the recording medium within several milliseconds. In this case, the permeation proceeds along paper fibers and the like. Thus, feathering of the ink or bleeding between different color inks occurs, and the formation of high-quality images is sometimes inhibited.

Accordingly, various measures have hitherto been proposed. However, it is still difficult to say that they are satisfactory. For example, techniques related to an ink jet recording method and an ink jet recording apparatus in which, after semi-curing of a photocurable pretreating agent on a recording medium, a photocurable ink is ejected by an ink jet method to form an image have been proposed (see, for example, Japanese Patent Application Laid-Open (JP-A) No. 2008-105382). According to this proposal, an undercoating layer is semi-cured before the ejection of the ink, and excessive spreading of ink droplets is prevented by the semi-curing.

However, conditions for the preparation of the semi-cured state are difficult, and, for example, uneven curing of complete curing in one portion and little or no curing in another portion occurs. The uneven curing poses a difference in spreading of ink droplets.

Japanese Patent Application Laid-Open (JP-A) No. 2004-42548 proposes an ink jet recording method that includes providing an energy beam curable color ink as ink, ejecting the energy beam curable color ink on a recording medium to form ink dots, irradiating the ink dots with energy beams according to ejection timing to thicken and precure the dots to such an extent that adjacent dots are not mixed together, then further irradiating the precured dots with energy beams to fully cure the dots. This proposed method can suppress feathering or bleeding but poses a problem that images are different among various recording media.

Japanese Patent Application Laid-Open (JP-A) No. 2004-244624 proposes an ink jet recording method that includes ejecting ink containing a cationically polymerizable ingredient curable with an actinic radiation on a recording medium through an ink jet recording head to deposit dots on the recording medium, and then irradiating the dots with an actinic radiation to cure the dots and thus to form an image, wherein a requirement of $A \leq B$ is satisfied wherein A represents a value of surface tension 1 of the ink, mN/m; and B represents surface tension 2 of the ink, mN/m. According to this proposal, high-definition images possessing anti-feathering, even density, and excellent smoothness of the formed images are obtained. However, it should be noted that, in this proposal, a relative surface tension difference between one pretreating liquid and color ink is merely compared and it is difficult to simultaneously meet various attributes of a wide variety of images.

On the other hand, when recording media such as films that do not absorb ink are used, drying by permeation is impossible and, thus, for example, ink that dries through vaporization of a solvent used, ink that is solidified by a phase change, and photopolymerizably curable ink are used. The fact that the shape and area of formed image dots vary depending upon the wettability of the recording medium by the ink poses a problem of stable formation of high-quality images. For example, a (beading) phenomenon that, in printing (solid image) on films having a surface that is less wettable by ink, ink droplets that have been previously deposited are attracted by ink droplets that have been deposited later are likely to occur, making it difficult to obtain even images when ink dots such as solid images are densely formed.

The surface treatment of the recording media can allow the recording media to be wetted by ink. On the other hand, when the recording media are likely to be wetted, dot feathering is likely to occur and pixels are spread. Accordingly, this technique is suitable for solid image formation but suffers from a problem that fine and high-definition expression is impossible.

Japanese Patent Application Laid-Open (JP-A) No. 2008-246837 proposes an ink jet recording method that includes an undercoating liquid application step of applying an undercoating liquid on a recording medium; a white ink application step of applying a white ink containing a white pigment; a curing step of semi-curing the applied undercoating liquid and white ink; and a recording step of ejecting an ink curable by actinic radiation irradiation on the semi-cured undercoating liquid and white ink to record an image.

Japanese Patent Application Laid-Open (JP-A) No. 2004-42525 proposes a method that includes evenly coating a radiation curable white ink as an undercoating layer on a transparent or semi-transparent recording medium, solidifying or thickening the coating by radiation irradiation, and then performing ink jet recording with a radiation curable color ink set. This proposal can reduce the problems of visibility of color inks, feathering or bleeding, and a difference in images among various recording media, but on the other hand, is unsatisfactory for eliminating uneven line widths, uneven colors or other problems attributable to mixing among liquid droplets.

When inks are overprinted, at a glance it seems that dense solid images can be formed. In fact, however, the thickness of the ink is increased, and surface concaves and convexes are increased in printing of general reactive inks, posing a problem that the optical density is disadvantageously lowered by irregular reflection.

There is a method that solid image expression and high-definition image expression are simultaneously realized by increasing the number of dots using small ink droplets. When high-speed printing is performed, small ink droplets ejected through nozzles are likely to be susceptible to an influence of wind produced in paper conveying or the like and ink deposition positions are unstable, making it difficult to form high-definition images.

Thus, in image recording on various recording media, simultaneous realization of high-density solid images and fine and high-definition image expression are difficult.

Accordingly, the provision of an ink jet recording method and an ink jet recording apparatus that can realize the formation of images having a high quality, that is, that, even when various recording media different from each other in ink absorption and wettability by ink are used, can realize high image evenness among various recording media, can effectively suppress ink feathering, can suppress the occurrence of uneven line widths and uneven colors attributable to mixing among liquid droplets, can realize high optical density expression that has little or no surface concaves and convexes and surface scattering even in high-density expression (solid image) portions having a high ink pixel density and, at the same time, can realize fine characters and expression of high-resolution and high-definition portions have been desired.

SUMMARY OF THE INVENTION

An object of the present invention is to provide an ink jet recording method and an ink jet recording apparatus that can realize the formation of images having a high quality, that is, that, even in use of various recording media different from each other in ink absorption and wettability by ink, can realize high image evenness among various recording media, can effectively suppress ink feathering, can suppress the occurrence of uneven line widths and uneven colors attributable to mixing among liquid droplets, can realize high optical density expression that has little or no surface concaves and convexes and surface scattering even in high-density expression (solid image) portions having a high ink pixel density and, at the same time, can realize fine characters and expression of high-resolution and high-definition portions.

The above object can be attained by the following means.

The ink jet recording method according to the present invention includes:

an energy beam curable liquid layer formation step of applying at least two energy beam curable liquids different from each other in surface tension on a recording medium to form an energy beam curable liquid layer having a distribution pattern of different surface tensions;

an ink ejection step of ejecting an energy beam curable ink on the energy beam curable liquid layer formed on the recording medium; and a curing step of irradiating the energy beam curable liquid layer and the energy beam curable ink with an energy beam to cure the energy beam curable liquid layer and the energy beam curable ink to form an image.

The ink jet recording method and the ink jet recording apparatus according to the present invention can attain an excellent effect that images having a high quality can be formed, that is, that, even in use of various recording media different from each other in ink absorption and wettability by ink, high image evenness among various recording media can be realized, ink feathering can be effectively suppressed, the occurrence of uneven line widths and uneven colors attributable to mixing among liquid droplets can be suppressed, high optical density expression that has little or no surface concaves and convexes and surface scattering even in high-density expression (solid image) portions having a high ink pixel density can be realized, and, at the same time, fine characters and expression of high-resolution and high-definition portions can be realized.

Figure 1:
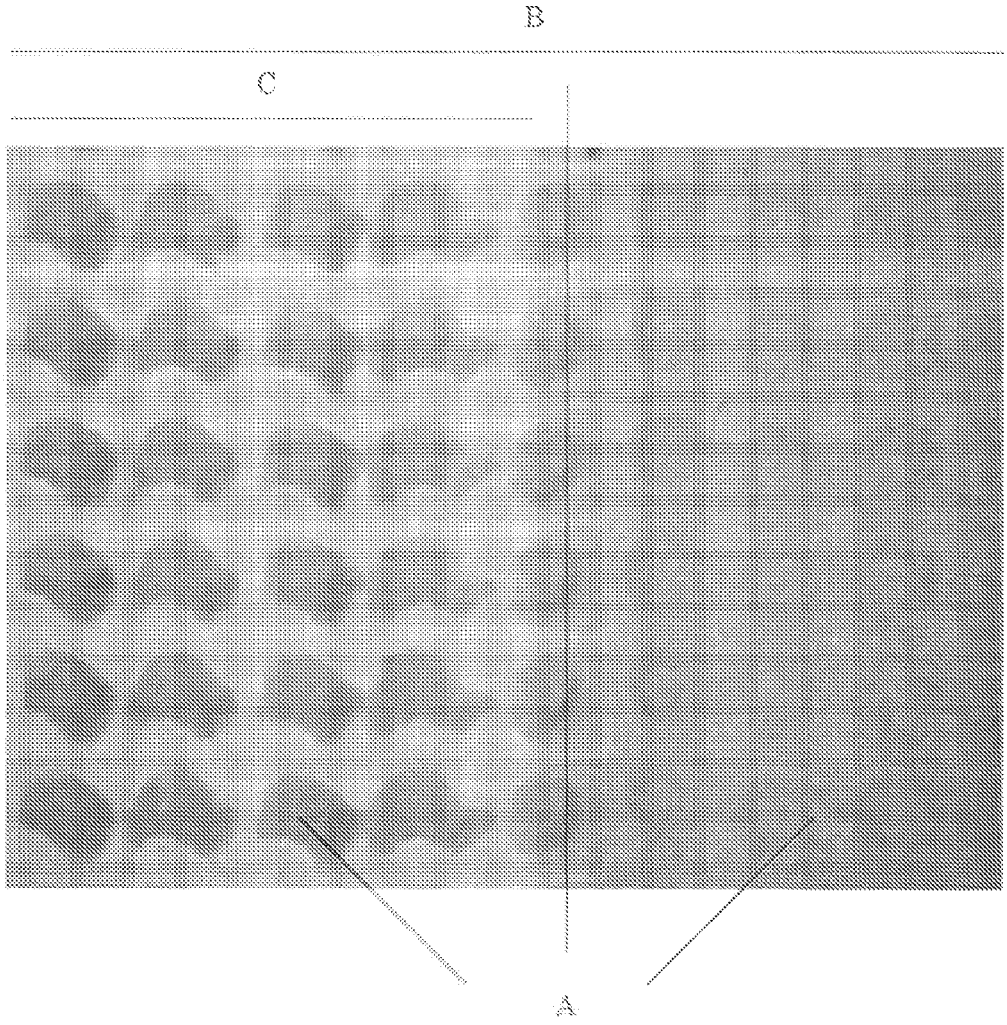
FIG. 1 is a microphotograph of an image formed in a working example.

DETAILED DESCRIPTION OF THE INVENTION (Ink Jet Recording Method and Ink Jet Recording Apparatus)

The ink jet recording method according to the present invention includes an energy beam curable liquid layer formation step, an ink ejection step, a curing step, and optional other steps.

The ink jet recording apparatus according to the present invention includes an energy beam curable liquid layer formation unit, an ink ejection unit, a curing unit, and optional other units.

The ink jet recording apparatus according to the present invention is suitable for carrying out the ink jet recording method according to the present invention. The energy beam curable liquid layer formation step can be carried out by the energy beam curable liquid layer formation unit. The ink ejection step can be carried out by the ink ejection unit. The curing step can be carried out by the curing unit. The other steps can be carried out by the other units.

In the present invention, rich image expression can be realized by forming an energy beam curable liquid layer having a surface tension pattern on a recording medium according to dot density of images and desired definition and ejecting an energy beam curable ink on the energy beam curable liquid layer having a surface tension pattern to regulate ink dot definition and spreading.

The utilization of the following two phenomena is important.

(I) When an energy beam curable ink A is ejected on an energy beam curable liquid C layer formed of the energy beam curable liquid C having a surface tension lower than the energy beam curable ink A formed on a recording medium, a part or the whole of ink droplets is permeated into the energy beam curable liquid C layer. In this state, curing is performed by energy irradiation to obtain ink dots that are suitable for high-definition images, have a smooth contour, and have a small diameter.

Even when such ink dots overlap with other ink dots having different colors, beautiful pixel dots can be formed without feathering and flowout of adjacent ink dot colors.

Further, when multi-color printing is performed through a plurality of ink jet heads directly on a recording medium highly wettable by ink, the spreading of ink dots vary due to a difference in timing from printing to curing, whereby the ink dot size disadvantageously varies. Ink dots permeated into an energy beam curable liquid C layer having a low surface tension spread more slowly than the direct printing. Accordingly, even when curing timing vary depending upon head positions for respective colors, ink dots having uniform diameters can be formed.

(II) The ejection, on an energy beam curable liquid B layer that has a high surface tension, is formed of an energy beam curable liquid B having a high surface tension and is formed on a recording medium, of an energy beam curable ink A having a surface tension higher than the energy beam curable liquid B layer having a high surface tension can allow the energy beam curable ink A to be instantaneously spread thinly on the energy beam curable liquid B layer having a high surface tension without permeation into the energy beam curable liquid B layer having a high surface tension on the recording medium and thus enables a solid image to be effectively formed in a smaller amount of ink.

Thus, the present invention utilizes phenomena (I) and (II) mentioned above, and a distribution pattern of different surface tensions is formed on a recording medium according to definition and solid portions of images to regulate the spreading of ink droplets ejected thereon, whereby a higher resolution and richer expression can be realized in an identical dot droplet amount.

The ink jet recording method according to the present invention includes feeding an energy beam curable liquid having a high surface tension on a recording medium to form a region of an energy beam curable liquid layer having a high surface tension, forming a region of an energy beam curable liquid having a low surface tension in at least a part of or at positions different from the energy beam curable liquid layer having a high surface tension, and forming ink dots at the positions.

The energy beam curable liquid having a high surface tension may be fed by any method without particular limitation, and the method may be properly selected according to contemplated purposes. Examples of such methods include various coating methods, blotted image printing methods, and feed through nozzle heads.

The region of energy beam curable liquid having a low surface tension may be formed by any method without particular limitation, and the method may be properly selected according to contemplated purposes. Examples of such methods include various coating methods and feed through nozzle heads.

The formation of the region by applying an energy beam curable liquid having a high surface tension is preferably performed earlier than the formation of the region by applying an energy beam curable liquid having a low surface tension for the reason that the feed of a surfactant into a part of the region of the energy beam curable liquid layer having a high surface tension can allow the surface tension of the portions into which the surfactant has been fed to be lowered, and for the reason that, when the energy beam curable liquid having a high surface tension is fed on the region (or a part of the region) of the energy beam curable liquid layer having a low surface tension, mixing between both the liquids is more significant.

In the ink jet recording method according to the present invention, a recording medium is fed from a recording medium feed portion and is conveyed to a portion where an energy beam curable liquid B is applied. An energy beam curable liquid B layer that has a high surface tension and is formed of an energy beam curable liquid B having a surface tension higher than the energy beam curable ink A on the recording medium is formed at the portion where the energy beam curable liquid B is applied.

Next, at a portion where an energy beam curable liquid C having a low surface tension is applied, an energy beam curable liquid C having a low surface tension is ejected on the energy beam curable liquid B layer to form an energy beam curable liquid C layer that has a low surface tension and is formed of the energy beam curable liquid C having a low surface tension.

An energy beam curable ink A is ejected at ink ejection portions according to an image pattern.

Thereafter, an energy beam radiation is applied by a curing unit configured to emit energy beams in a wavelength range capable of curing the liquids to cure the energy beam curable liquid B layer having a high surface tension, the energy beam curable liquid C layer having a low surface tension, and the energy beam curable ink A on the recording medium and thus to form an image.

High-density solid images and fine and high-definition image expression can be simultaneously realized when the energy beam curable liquid B having a high surface tension, the energy beam curable liquid C having a low surface tension, and the energy beam curable ink A satisfy the following relationship and are used in image formation.

(1) Static surface tension of energy beam curable liquid B having high surface tension>static surface tension of energy beam curable ink A The static surface tension of the energy beam curable liquid B having a high surface tension is preferably higher than 30 mN/m, more preferably 35 mN/m to 45 mN/m.

The viscosity of the energy beam curable liquid B having a high surface tension is more preferably 10 mPa·s to 10,000 mPa·s at 25° C.

The static surface tension and the viscosity of the energy beam curable ink A are preferably 25 mN/m to 35 mN/m and 10 mPa·s to 60 mPa·s at 25° C., respectively.

(2) Static surface tension of energy beam curable liquid C having low surface tension≤static surface tension of energy beam curable ink A The static surface tension of the energy beam curable liquid C having a low surface tension is preferably 30 mN/m or less, more preferably 20 mN/m to 25 mN/m.

The viscosity of the energy beam curable liquid C having a low surface tension is more preferably 10 mPa·s to 100 mPa·s at 25° C.

<Energy Beam Curable Liquid Layer Formation Step and Energy Beam Curable Liquid Layer Formation Unit>

The energy beam curable liquid layer formation step is a step of applying at least two energy beam curable liquids different from each other in surface tension on a recording medium to form an energy beam curable liquid layer having a distribution pattern of different surface tensions and may be carried out by an energy beam curable liquid layer formation unit.

Preferably, the energy beam curable liquid layer having a distribution pattern of different surface tensions has a high surface tension region formed of an energy beam curable liquid having a surface tension higher than the energy beam curable ink and a low surface tension region formed of an energy beam curable liquid having a surface tension equal to or lower than the energy beam curable ink, and the following embodiments may be mentioned.

(1) An embodiment wherein an energy beam curable ink is ejected on the low surface tension region to form a high resolution expression image formation region.

(2) An embodiment wherein an energy beam curable ink is ejected on the low surface tension region to form a halftone image formation region.

(3) An embodiment wherein an energy beam curable ink is ejected on the high surface tension region to form a solid image formation region.

Preferably, an energy beam curable liquid layer having a surface tension lower than the solid image formation region is formed at a contour portion in the solid image formation region.

Preferably, the energy beam curable liquid layer formation step includes:

a step of applying, onto a recording medium, an energy beam curable liquid having a surface tension higher than an energy beam curable ink, to thereby form an energy beam curable liquid layer having a high surface tension; and a step of forming an energy beam curable liquid layer having a surface tension lower than the energy beam curable ink on at least a part of the energy beam curable liquid layer having a high surface tension.

Preferably, the energy beam curable liquid layer formation step includes:

a step of applying, onto a recording medium, an energy beam curable liquid having a surface tension higher than an energy beam curable ink, to thereby form an energy beam curable liquid layer having a high surface tension;

a step of applying a surfactant-containing liquid to the formed energy beam curable liquid layer having a high surface tension to form a surfactant-containing liquid layer.

Preferably, the energy beam curable liquid layer formation step includes:

a step of applying, onto a recording medium, an energy beam curable liquid having a viscosity and a surface tension that are higher than an energy beam curable ink, to thereby form an energy beam curable liquid layer having a high surface tension; and a step of applying a surfactant-containing liquid on the formed energy beam curable liquid layer having a high surface tension to form a surfactant-containing liquid layer.

Preferably, the energy beam curable liquid layer formation step includes:

a step of ejecting, onto a recording medium through an ink jet head, an energy beam curable liquid which has a high surface tension and whose viscosity is to be higher than that upon the ejecting, to thereby form an energy beam curable liquid layer having a high surface tension; and a step of applying a surfactant-containing liquid on at least a part of the formed energy beam curable liquid layer having a high surface tension to form a surfactant-containing liquid layer.

Preferably, the energy beam curable liquid layer formation step includes:

a step of ejecting, onto a recoding medium through an ink jet head, an energy beam curable liquid which has a high surface tension and whose viscosity is to be higher than that upon the ejecting, to thereby form an energy beam curable liquid layer having a high surface tension; and a step of applying a surfactant-containing liquid on a part other than the formed energy beam curable liquid layer having a high surface tension to form a surfactant-containing liquid layer.

<<Energy Beam Curable Liquid Having High Surface Tension>>

The energy beam curable liquid having a high surface tension is not particularly limited and may be properly selected according to contemplated purposes. Examples thereof include a liquid containing 3% by mass of a reaction initiator (Irgacure 379 manufactured by BASF) and 97% by mass of a photocurable resin monomer (a caprolactane-modified dip entaerythritol hexaacrylate, KAYARAD DPCA60, manufactured by Nippon Kayaku Co., Ltd.).

<<Energy Beam Curable Liquid Having Low Surface Tension>>

The energy beam curable liquid having a low surface tension is not particularly limited and may be properly selected according to contemplated purposes. Examples thereof include a liquid containing 27% by mass of a polymerizable compound (Viscoat V#1000 manufactured by Osaka Organic Chemical Industry Ltd.), 63% by mass of another polymerizable compound (dioxolane acrylate, MEDOL10 manufactured by Osaka Organic Chemical Industry Ltd.), 9% by mass of a reaction initiator (Irgacure 379 manufactured by BASF) and 1% by mass of a surfactant (BYK3510 manufactured by BYK-Chemie).

<<Surfactant-Containing Liquid>>

The surfactant-containing liquid is not particularly limited and may be properly selected according to contemplated purposes. Examples thereof include a liquid containing 85% by mass of a polymerizable compound (dioxolane acrylate, MEDOL10 manufactured by Osaka Organic Chemical Industry Ltd.), 5% by mass of a reaction initiator (Irgacure 379 manufactured by BASF) and 10% by mass of a surfactant (BYK3510 manufactured by BYK-Chemie).

<<Recording Medium>>

The recording medium may be various recording media different in ink absorption and wettability to ink, and examples thereof include easily-permeable plain paper, hardly-permeable coat paper, and non-permeable films.

Examples of the easily-permeable plain paper include various plain paper such as MY PAPER (manufactured by Ricoh Company, Ltd.), coat paper, cardboard and pasteboard.

Examples of the plain paper and the coat paper include paper specialized for ink jet, commonly-used paper for electrophotography, and cloth described in, for example, JP-A Nos. 10-153989, 10-217473, 10-235995, 10-217597 and 10-337947.

Also, the plain paper and the coat paper may be commercially available products. Examples thereof include MY PAPER (manufactured by NBS Ricoh Company, Ltd.), PB paper (manufactured by Canon Inc.), "YAMAYURI" (manufactured by Honshu Seishi Co., Ltd., recycled paper), XEROX 4024 (manufactured by Fuji Xerox Office Supply Co. Ltd.), DF COLOR GN (manufactured by MITSUBISHI PAPER MILLS LIMITED.) and DPIJ GLOSS (manufactured by MITSUBISHI PAPER MILLS LIMITED.).

Examples of the hardly-permeable coat paper include various coat paper such as POD GLOSS COAT 100, MIRROR COAT, OK TOP COAT and LUMIART GLOSS (all of which are manufactured by Oji Paper Co., Ltd.).

Examples of the non-permeable films include LUMILAR E-20 (matt) and LUMILAR X-20 (gloss) (both of which are manufactured by TORAY INDUSTRIES, INC.).

Further examples of the non-permeable films include plastic sheet base materials, plastic film base materials, metal base materials, glass base materials and plastic coat paper, with plastic sheet base materials, plastic film base materials, metal base materials and glass base materials being preferred.

Examples of the material of the plastic sheet or plastic film include synthetic resins such as polyesters (e.g., polyvinyl chloride, polyethylene terephthalate (PET), polybutylene terephthalate and polyethylene naphthalate (PEN)), polycarbonate (PC), polymethyl methacrylate (PMMA), polyarylate, triacetyl cellulose (TAC) and polypropylene (PP).

<Ink Ejection Step and Ink Ejection Unit>

The ink ejection step is a step of ejecting an energy beam curable ink on the energy beam curable liquid layer formed on the recording medium and is carried out by an ink ejection unit.

<<Energy Beam Curable Ink>>

The energy beam curable ink is not particularly limited as long as it is curable upon the absorption of energy beams. The energy beam curable ink may be properly selected according to contemplated purposes. The energy beam curable ink contains a vehicle, a colorant and optionally other ingredients such as leveling agents, reaction accelerators, reaction inhibitors, and sensitizers.

Colorant-free clear inks and color inks containing black, cyan, magenta, yellow or other coloring materials are mainly used as a energy beam curable ink. Further, white ink and light color inks for richening gradation rendering may be used in combination with the above inks.

For example, when a white liquid is used as the energy beam curable liquid B having a high surface tension and a clear liquid is used as the energy beam curable liquid C having a low surface tension, it is possible to obtain a high-contrast image regardless of reflectivity of the recording medium.

—Vehicle—

The vehicle contains a polymerizable compound and a photoinitiator.

Examples of such polymerizable compounds include cationically polymerizable compounds, radically polymerizable compounds, and photocurable resin monomers. One of them may be used, or alternatively at least two of them may be used as a mixture. All of them have a good capability of wetting the recording medium and have excellent adhesion to a wide range of various adherend materials.

—Cationically Polymerizable Compound—

Examples of cationically polymerizable compounds include epoxy compounds and oxetane compounds.

Examples of such epoxy compounds include bisphenol A epoxies, bisphenol BA epoxies, bisphenol F epoxies, bisphenol AD epoxies, phenol novolak epoxies, cresol novolak epoxies, alicyclic epoxies, fluorene epoxies, naphthalene epoxies, glycidyl ester compounds, glycidylamine compounds, heterocyclic epoxies, and α-olefin epoxies. Among them, alicyclic epoxies are preferred from the viewpoints of a low viscosity and a high curing speed.

Examples of such alicyclic epoxies include 3,4-epoxycyclohexenylmethyl-3',4'-epoxycyclohexenecarboxylate or ϵ-caprolactone-modified products thereof, bis-(3,4-epoxycyclohexylmethyl)adipate, 1,2:8,9-diepoxylimonene, and vinylcyclohexene monoxide 1,2-epoxy-4-vinylcyclohexane.

The oxetane compounds are not particularly limited and may be properly selected according to properties required of inks. When the adhesion to the base material is particularly important, for example, 3-ethyl-3-(phenoxymethyl)oxetane may be mentioned.

Preferably, the cationically polymerizable ink further contains a vinyl ether compound.

Examples of such vinyl ether compounds include 2-ethylhexyl vinyl ether, butanediol-1,4-divinyl ether, cyclohexanedimethanol monovinyl ether, diethylene glycol monovinyl ether, diethylene glycol divinyl ether, dipropylene glycol divinyl ether, dodecyl vinyl ether, ethyl vinyl ether, hexanediol divinyl ether, hydroxybutyl vinyl ether, hydroxyethyl vinyl ether, isobutyl vinyl ether, methyl vinyl ether, octadecyl vinyl ether, propyl vinyl ether, triethylene glycol divinyl ether, vinyl 4-hydroxybutyl ether, vinyl cyclohexyl ether, vinyl propionate, vinyl carbazole, and vinyl pyrrolidone.

If necessary, propenyl ether and butenyl ether may be incorporated in the cationically polymerizable ink. Examples thereof include 1-dodecyl-1-propenyl ether, 1-dodecyl-1-butenyl ether, 1-butenoxymethyl-2-norbonene, 1-4-di(1-butenoxy)butane, 1,10-di(1-butenoxy)decane, 1,4-di(1-butenoxymethyl)cyclohexane, diethylene glycol di(1-butenyl)ether, and 1,2,3-tri(1-butenoxy)propane, propenyl ether propylenecarbonate.

The cation polymerization initiator is not particularly limited as long as the initiator is a compound, when exposed to energy beams such as ultraviolet light, can produce a substance that induces polymerization. Onium salts, for example, arylsulfonium salts and aryliodonium salts are suitable. If necessary, photosensitizers such as N-vinyl carbazole, thioxanthone compounds and anthracene compounds such as 9,10-dibutoxyanthracene may be used in combination with the initiator.

—Radically Polymerizable Compound—

Various conventional radically polymerizable monomers that can induce a polymerization reaction by initiation species generated from the radical polymerization initiator are preferred as the radically polymerizable compound.

Examples of such radically polymerizable monomers include monofunctional (meth)acrylates, difunctional (meth) acrylates, trifunctional (meth)acrylates, (meth)acrylamides, aromatic vinyls, vinyl ethers, polyfunctional vinyl ethers, and compounds having an internal double bond (such as maleic acid).

The monofunctional (meth)acrylates are not particularly limited and may be properly selected according to contemplated purposes. Examples thereof include hexyl (meth)acrylate, 2-ethylhexyl (meth)acrylate, tert-octyl (meth)acrylate, isoamyl (meth)acrylate, decyl (meth)acrylate, isodecyl (meth)acrylate, stearyl (meth)acrylate, isostearyl (meth)acrylate, cyclohexyl (meth)acrylate, 4-n-butyl cyclohexyl (meth) acrylate, bornyl (meth)acrylate, isobornyl (meth)acrylate, benzyl (meth)acrylate, 2-ethylhexyl diglycol (meth)acrylate, butoxyethyl (meth)acrylate, 2-chloroethyl (meth)acrylate, 4-bromobutyl (meth)acrylate, cyanoethyl (meth)acrylate, butoxymethyl (meth)acrylate, 3-methoxybutyl (meth)acrylate, alkoxymethyl (meth)acrylate, alkoxyethyl (meth)acrylate, 2-(2-methoxyethoxy)ethyl (meth)acrylate, 2-(2-butoxyethoxy)ethyl (meth)acrylate, 2,2,2-trifluoroethyl (meth) acrylate, 1H,1H,2H,2H-perfluorodecyl (meth)acrylate, 4-butyl phenyl (meth)acrylate, phenyl (meth)acrylate, 2,4,5-tetramethylphenyl (meth)acrylate, 4-chlorophenyl (meth) acrylate, phenoxymethyl (meth)acrylate, phenoxyethyl (meth)acrylate, glycidyl (meth)acrylate, glycidyloxybutyl (meth)acrylate, glycidyloxyethyl (meth)acrylate, glycidyloxypropyl (meth)acrylate, tetrahydrofurfuryl (meth)acrylate, hydroxyalkyl (meth)acrylate, 2-hydroxyethyl (meth)acrylate, 3-hydroxypropyl (meth)acrylate, 2-hydroxypropyl (meth)acrylate, 2-hydroxybutyl (meth)acrylate, 4-hydroxybutyl (meth)acrylate, dimethylaminoethyl (meth)acrylate, diethylaminoethyl (meth)acrylate, dimethylaminopropyl (meth)acrylate, diethylaminopropyl (meth)acrylate, trimethoxysilylpropyl (meth)acrylate, trimethylsilylpropyl (meth)acrylate, polyethylene oxide monomethyl ether (meth) acrylate, oligoethylene oxide monomethyl ether (meth)acrylate, polyethylene oxide (meth)acrylate, oligoethylene oxide (meth)acrylate, oligoethylene oxide monoalkyl ether (meth) acrylate, polyethylene oxide monoalkyl ether (meth)acrylate, dipropylene glycol (meth)acrylate, polypropylene oxide monoalkyl ether (meth)acrylate, oligopropylene oxide monoalkyl ether (meth)acrylate, 2-methacryloyloxyethylsuccinic acid, 2-methacryloyloxyhexahydrophthalic acid, 2-methacryloyloxyethyl-2-hydroxypropyl phthalate, butoxydiethylene glycol (meth)acrylate, trifluoroethyl (meth)acrylate, perfluorooctylethyl (meth)acrylate, 2-hydroxy-3-phenoxypropyl (meth)acrylate, EO-modified phenol (meth) acrylate, EO-modified cresol (meth)acrylate, EO-modified nonyl phenol (meth)acrylate, PO-modified nonyl phenol (meth)acrylate, and EO-modified-2-ethylhexyl (meth)acrylate.

The (meth)acrylamides are not particularly limited and may be properly selected according to contemplated purposes. Examples thereof include (meth)acrylamide, N-methyl (meth)acrylamide, N-ethyl (meth)acrylamide, N-propyl (meth)acrylamide, N-n-butyl (meth)acrylamide, N-t-butyl (meth)acrylamide, N-butoxymethyl (meth)acrylamide, N-isopropyl (meth)acrylamide, N-methylol (meth)acrylamide, N,N-dimethyl (meth)acrylamide, N,N-diethyl (meth) acrylamide, and (meth)acryloylmorepholine.

The aromatic vinyls are not particularly limited and may be properly selected according to contemplated purposes. Examples thereof include styrene, methylstyrene, dimethylstyrene, trimethylstyrene, ethylstyrene, isopropyl styrene, chloromethylstyrene, methoxystyrene, acetoxystyrene, chlorostyrene, dichlorostyrene, bromostyrene, vinylbenzoic acid methyl ester, 3-methylstyrene, 4-methylstyrene, 3-ethylstyrene, 4-ethylstyrene, 3-propylstyrene, 4-propylstyrene, 3-butylstyrene, 4-butylstyrene, 3-hexylstyrene, 4-hexylstyrene, 3-octylstyrene, 4-octylstyrene, 3-(2-ethylhexyl)styrene, 4-(2-ethylhexyl)styrene, allylstyrene, isopropenylstyrene, butenylstyrene, octenylstyrene, 4-t-butoxycarbonylstyrene, 4-methoxystyrene, and 4-t-butoxystyrene.

The difunctional (meth)acrylates are not particularly limited and may be properly selected according to contemplated purposes. Examples thereof include 1,6-hexanediol di(meth) acrylate, 1,10-decanediol di(meth)acrylate, neopentyl glycol di(meth)acrylate, 2,4-dimethyl-1,5-pentanediol di(meth) acrylate, butyl ethylpropanediol (meth)acrylate, ethoxylated cyclohexane methanol di(meth)acrylate, polyethylene glycol di(meth)acrylate, oligoethylene glycol di(meth)acrylate, ethylene glycol di(meth)acrylate, 2-ethyl-2-butyl-butanediol di(meth)acrylate, hydroxypivalic acid neopentylglycol di(meth)acrylate, EO-modified bisphenol A di(meth)acrylate, bisphenol F polyethoxy di(meth)acrylate, polypropylene glycol di(meth)acrylate, oligopropylene glycol di(meth) acrylate, 1,4-butanediol di(meth)acrylate, 2-ethyl-2-butyl propanediol di(meth)acrylate, 1,9-nonane di(meth)acrylate, propoxylated ethoxylated bisphenol A di(meth)acrylate, and tricyclodecane di(meth)acrylate.

The trifunctional (meth)acrylates are not particularly limited and may be properly selected according to contemplated purposes. Examples thereof include trimethylolpropane tri (meth)acrylate, trimethylolethane tri(meth)acrylate, alkylene oxide-modified tri(meth)acrylate of trimethylolpropane, pentaerythritol tri(meth)acrylate, dipentaerythritol tri(meth) acrylate, trimethylolpropane tris((meth)acryloyloxypropyl) ether, isocyanuric acid alkylene oxide-modified tri(meth) acrylate, propionic acid dipentaerythritol tri(meth)acrylate, tris((meth)acryloyloxyethyl) isocyanurate, hydroxypivalaldehyde-modified dimethylolpropane tri(meth)acrylate, sorbitol tri(meth)acrylate, propoxylated trimethylolpropane tri (meth)acrylate, and ethoxylated glycerin tri(meth)acrylate.

The vinyl ethers are not particularly limited and may be properly selected according to contemplated purposes. Examples thereof include methyl vinyl ether, ethyl vinyl ether, propyl vinyl ether, n-butyl vinyl ether, t-butyl vinyl ether, 2-ethylhexyl vinyl ether, n-nonyl vinyl ether, lauryl vinyl ether, cyclohexyl vinyl ether, cyclohexyl methylvinyl ether, 4-methylcyclohexyl methylvinyl ether, benzyl vinyl ether, dicyclopentenyl vinyl ether, 2-dicyclopentenoxyethyl vinyl ether, methoxyethyl vinyl ether, ethoxyethyl vinyl ether, butoxyethyl vinyl ether, methoxyethoxyethyl vinyl ether, ethoxyethoxyethyl vinyl ether, methoxypolyethylene glycol vinyl ether, tetrahydrofurfuryl vinyl ether, 2-hydroxyethyl vinyl ether, 2-hydroxypropyl vinyl ether, 4-hydroxybutyl vinyl ether, 4-hydroxymethyl cyclohexylmethylvinyl ether, diethylene glycol monovinyl ether, polyethylene glycol vinyl ether, chloroethyl vinyl ether, chlorobutyl vinyl ether, chloroethoxyethyl vinyl ether, phenylethyl vinyl ether, and phenoxypolyethylene glycol vinyl ether.

Examples of divinyl ethers include ethylene glycol divinyl ether, diethylene glycol divinyl ether, polyethylene glycol divinyl ether, propylene glycol divinyl ether, butylene glycol divinyl ether, hexanediol divinyl ether, bisphenol A alkylene oxide divinyl ether, and bisphenol F alkylene oxide divinyl ether.

Examples of polyfunctional vinyl ethers include trimethylolethane trivinyl ether, trimethylolpropane trivinyl ether, ditrimethylolpropane tetravinyl ether, glycerin trivinyl ether, pentaerythritol tetravinyl ether, dipentaerythritol pentavinyl ether, dipentaerythritol hexavinyl ether, ethylene oxide-added trimethylolpropane trivinyl ether, propylene oxide-added trimethylolpropane trivinyl ether, ethylene oxide-added ditrimethylolpropane tetravinyl ether, propylene oxide-added ditrimethylolpropane tetravinyl ether, ethylene oxide-added pentaerythritol tetravinyl ether, propylene oxide-added pentaerythritol tetravinyl ether, ethylene oxide-added dipentaerythritol hexavinyl ether, and propylene oxide-added dipentaerythritol hexavinyl ether.

Among them, divinyl ether compounds or trivinyl ether compounds are preferred from the viewpoints of curability, adhesion to recording media, surface hardness of the formed images and the like. Divinyl ether compounds are particularly preferred.

—Photocurable Resin Monomer—

The photocurable resin monomer is preferably a resin monomer that has a radically polymerizable unsaturated double bond in a molecular structure thereof and has a relatively low viscosity. Examples thereof include monofunctional resin monomers such as 2-ethylhexyl (meth)acrylate (EHA), 2-hydroxyethyl (meth)acrylate (HEA), 2-hydroxypropyl (meth)acrylate (HPA), caprolactone-modified tetrahydrofurfuryl (meth)acrylate, isobonyl (meth)acrylate, 3-methoxybutyl (meth)acrylate, tetrahydrofurfuryl (meth) acrylate, lauryl (meth)acrylate, 2-phenoxyethyl (meth)acrylate, isodecyl (meth)acrylate, isooctyl (meth)acrylate, tridecyl (meth)acrylate, caprolactone (meth)acrylate, and ethoxylated nonyl phenol (meth)acrylate; difunctional resin monomers such as tripropylene glycol di(meth)acrylate, triethylene glycol di(meth)acrylate, tetraethylene glycol di(meth)acrylate, polypropylene glycol di(meth)acrylate, neopentylglycol hydroxypivalic acid ester di(meth)acrylate (MANDA) and hydroxypivalic acid neopentyl glycol ester di(meth)acrylate (HPNDA), 1,3-butanediol di(meth)acrylate (BGDA), 1,4-butanediol di(meth)acrylate (BUDA), 1,6-hexanediol di(meth)acrylate (HDDA), 1,9-nonanediol di(meth) acrylate, diethylene glycol di(meth)acrylate (DEGDA), neopentylglycol di(meth)acrylate (NPGDA), tripropylene glycol di(meth)acrylate (TPGDA), caprolactone-modified hydroxypivalic acid neopentyl glycol ester di(meth)acrylate, propoxylated neopentyl glycol di(meth)acrylate, ethoxy-modified bisphenol A di(meth)acrylate, polyethylene glycol 200 di(meth)acrylate, polyethylene glycol 400 di(meth)acrylate; and polyfunctional resin monomers such as trimethylolpropane tri(meth)acrylate (TMPTA), pentaerythritol tri(meth) acrylate (PETA), dipentaerythritol hexa(meth)acrylate (DPHA), triallyl isocyanate, ϵ-caprolactone-modified dipentaerythritol (meth)acrylate, tris(2-hydroxyethyl) isocyanurate tri(meth)acrylate, ethoxylated trimethylolpropane tri (meth)acrylate, propoxylated trimethylolpropane tri(meth) acrylate, propoxylated glyceryl tri(meth)acrylate, pentaerythritol tetra(meth)acrylate, ditrimethylolpropane tetra(meth)acrylate, dipentaerythritolhydroxy penta(meth) acrylate, ethoxylated pentaerythritol tetra(meth)acrylate, and penta(meth)acrylate esters.

Commercially available products may be used as the photocurable resin monomer. Examples of such commercially available products include KAYARAD TC-110S, KAYARAD R-128H, KAYARAD R-526, KAYARAD NPGDA, KAYARAD PEG400DA, KAYARAD MANDA, KAYARAD R-167, KAYARAD HX-220, KAYARAD HX-620, KAYARAD R-551, KAYARAD R-712, KAYARAD R-604, KAYARAD R-684, KAYARAD GPO, KAYARAD TMPTA, KAYARAD THE-330, KAYARAD TPA-320, KAYARAD TPA-330, KAYARAD PET-30, KAYARAD RP-1040, KAYARAD T-1420, KAYARAD DPHA, KAYARAD DPHA-2C, KAYARAD D-310, KAYARAD D-330, KAYARAD DPCA-20, KAYARAD DPCA-30, KAYARAD DPCA-60, KAYARAD DPCA-120, KAYARAD DN-0075, KAYARAD DN-2475, KAYAMER PM-2, KAYAMER PM-21, KS series HDDA, TPGDA, TMPTA, SR series 256, 257, 285, 335, 339A, 395, 440, 495, 504, 111, 212, 213, 230, 259, 268, 272, 344, 349, 601, 602, 610, 9003, 368, 415, 444, 454, 492, 499, 502, 9020, 9035, 295, 355, 399E494, 9041203, 208, 242, 313, 604, 205, 206, 209, 210, 214, 231E239, 248, 252, 297, 348, 365C, 480, 9036, and 350 (all the above products being manufactured by NIPPON KAYAKU Co., LTD.) and Beam Set 770 (manufactured by ARAKAWA CHEMICAL INDUSTRIES, LTD.).

—Photoinitiator—

Examples of photoinitiators include benzoin ether compounds, acetophenone compounds, benzophenone compounds, benzophenone, thioxanthone compounds, acylphosphine oxide, and methylphenyl glyoxylate.

Examples of more specific photoinitiators include benzoin alkyl ethers, benzylmethyl ketals, hydroxycyclohexyl phenyl ketone, p-isopropyl-α-hydroxyisobutylphenone, 1,1-dichloroacetophenone, and 2-chlorothioxanthone.

The content of the photoinitiator is preferably 0.01% by mass to 10% by mass based on the total amount of the vehicle.

Examples of photoinitiation auxiliaries include triethanolamine, ethyl 2-dimethylaminobenzoate, isoamyl 4-dimethylaminobenzoate, and polymerizable tertiary amines.

Commercially available products may be used as the photoinitiator. Examples of such commercially available products include Vicure 10, 30, and 55 (manufactured by Stauffer); KAYACURE BP-100, KAYACURE BMS, KAYACURE DETX-S, KAYACURE CTX, KAYACURE 2-EAQ, KAYACURE DMBI, and KAYACURE EPA (all the above products being manufactured by Nippon Kayaku Co., Inc.); IRGACURE 651, 184, 907, and 369 (all the above products being manufactured by Ciba-Geigy Ltd.); DAROCURE 1173, 1116, 953, 2959, 2273, and 1664 (all the above products being manufactured by Merck & Co., Inc.); Sandre 1000 (manufactured by Sandoz K.K.); Counter Cure CTX, Counter Cure BMS, Counter Cure ITX, Counter Cure PDO, and Counter Cure BEA and DMB (all the above products being manufactured by Ward Blenkinsop); and Suncure IP and BTTP (manufactured by Nippon Oils & Fats Co., Ltd.). Further, photoinitiator-containing photocurable resins may also be used.

<<Colorant>>

The colorant is not particularly limited and may be properly selected, for example, from conventional water soluble dyes, oil soluble dyes, and pigments. Among them, oil soluble dyes and pigments that can easily be homogeneously dispersed or dissolved in water insoluble media are particularly preferred.

Pigments that can be well dispersed in the vehicle and have excellent weathering resistance are preferred as the colorant. Such pigments include, but are not particularly limited to, organic or inorganic pigments of the following color index numbers.

Red or magenta pigments include, for example, C.I. Pigment Red 3, 5, 19, 22, 31, 38, 43, 48:1, 48:2, 48:3, 48:4, 48:5, 49:1, 53:1, 57:1, 57:2, 58:4, 63:1, 81, 81:1, 81:2, 81:3, 81:4, 88, 104, 108, 112, 122, 123, 144, 146, 149, 166, 168, 169, 170, 177, 178, 179, 184, 185, 208, 216, 226, and 257, C.I. Pigment Violet 3, 19, 23, 29, 30, 37, 50, and 88, and C.I. Pigment Orange 13, 16, 20, and 36.

Blue or cyan pigments include, for example, C.I. Pigment Blue 1, 15, 15:1, 15:2, 15:3, 15:4, 15:6, 16, 17-1, 22, 27, 28, 29, 36, and 60.

Green pigments include, for example, C.I. Pigment Green 7, 26, 36, and 50.

Yellow pigments include, for example, C.I. Pigment Yellow 1, 3, 12, 13, 14, 17, 34, 35, 37, 55, 74, 81, 83, 93, 94, 95, 97, 108, 109, 110, 137, 138, 139, 153, 154, 155, 157, 166, 167, 168, 180, 185, and 193.

Black pigments include, for example, C.I. Pigment Black 7, 28, and 26.

Commercially available products may be used as the colorant. Examples of such commercially available products include CHROMOFINE Yellow 2080, 5900, and 5930, AF-1300, 2700L, CHROMOFINE ORANGE 3700L and 6730, CHROMOFINE SCARLET 6750, CHROMOFINE MAGENTA 6880, 6886, 6891N, 6790, and 6887, CHROMOFINE VIOLET RE, CHROMOFINE RED 6820 and 6830, CHROMOFINE BLUE HS-3, 5187, 5108, 5197, 5085N, SR-5020, 5026, 5050, 4920, 4927, 4937, 4824, 4933GN-EP, 4940, 4973, 5205, 5208, 5214, 5221, and 5000P, CHROMOFINE GREEN 2GN, 2GO, 2G-550D, 5310, 5370, and 6830, CHROMOFINE BLACK A-1103, SEIKAFAST YELLOW 10GH, A-3, 2035, 2054, 2200, 2270, 2300, 2400 (B), 2500, 2600, ZAY-260, 2700 (B), and 2770, SEIKAFAST RED 8040, C405 (F), CA120, LR-116, 1531B, 8060R, 1547, ZAW-262, 1537B, GY, 4R-4016, 3820, 3891, and ZA-215, SEIKAFAST CARMINE 6B1476T-7, 1483LT, 3840, and 3870, SEIKAFAST BORDEAUX 10B-430, SEIKALIGHT ROSE R40, SEIKALIGHT VIOLET B800 and 7805, SEIKAFAST MAROON 460N, SEIKAFAST ORANGE 900 and 2900, SEIKALIGHT BLUE C718 and A612, CYANINE BLUE 4933M, 4933GN-EP, 4940, and 4973 (all the above products being manufactured by Dainichi Color & Chemical Mfg. Co., Ltd.); KET Yellow 401, 402, 403, 404, 405, 406, 416, and 424, KET Orange 501, KET Red 301, 302, 303, 304, 305, 306, 307, 308, 309, 310, 336, 337, 338, and 346, KET Blue 101, 102, 103, 104, 105, 106, 111, 118, and 124, KET Green 201 (all the above products being manufactured by DIC Corporation); Colortex Yellow 301, 314, 315, 316, P-624, 314, U10GN, U3GN, UNN, UA-414, and U263, Finecol Yellow T-13, and T-05, Pigment Yellow 1705, Colortex Orange 202, Colortex Red 101, 103, 115, 116, D3B, P-625, 102, H-1024, 105C, UFN, UCN, UBN, U3BN, URN, UGN, UG276, U456, U457, 105C, and USN, Colortex Maroon 601, Colortex Brown B610N, Colortex Violet 600, Pigment Red 122, Colortex Blue 516, 517, 518, 519, A818, P-908, and 510, Colortex Green 402, and 403, Colortex Black 702, and U905 (all the above products being manufactured by SANYO COLOR WORKS, Ltd.), Lionol Yellow 1405G, Lionol Blue FG7330, FG7350, FG7400G, FG7405G, ES, and ESP-S (all the above products being manufactured by TOYO INK Mfg. Co., Ltd.); Toner Magenta E02, Permanent Rubin F6B, Toner Yellow HG, Permanent Yellow GG-02, and Hostaperm Blue B2G (all the above products being manufactured by Hoechst Industry Ltd.); and Carbon Black #2600, #2400, #2350, #2200, #1000, #990, #980, #970, #960, #950, #850, MCF88, #750, #650, MA600, MA7, MA8, MA11, MA100, MA100R, MA77, #52, #50, #47, #45, #45L #40, #33, #32, #30, #25, #20, #10, #5, #44, and CF9 (all the above products being manufactured by Mitsubishi Chemical Corporation).

The content of the colorant is preferably 1 part by mass to 20 parts by mass. When the content is less than 0.1 part by mass, the image quality is sometimes lowered. On the other hand, a content of more than 20 parts by mass sometimes adversely affects ink viscosity properties. Two or more colorants may be properly used as a mixture for color adjustment purposes and the like.

Water and solvents may be added for viscosity lowering and speed increase purposes. Any solvent may be used as long as it can well dissolve all the constituents of the ink and can be rapidly evaporated after printing. Preferably, the solvent is composed mainly of ketone and/or alcohol. For example, acetone, methyl ethyl ketone, methyl isobutyl ketone, methanol, ethanol, and isopropanol are preferably used solely or as a mixture or as a mixed solvent with water.

Various sensitizers, photostabilizers, surface treating agents, surfactants, viscosity lowering agents, antioxidants, anti-aging agents, crosslinking accelerators, polymerization inhibitors, plasticizers, preservatives, pH adjustors, anti-foaming agents, humectants, dispersants, and dyes may be mixed into the ink to develop further functionality.

Bead mills and homogenizers are optimal for mixing and dispersion of the vehicle, colorant, and other ingredients. However, well-known various grinding or dispersing apparatuses can be used without particular limitation.

<Curing Step and Curing Unit>

The curing step is a step of irradiating the energy beam curable liquid layer and the energy beam curable ink with energy beams to cure the energy beam curable liquid layer and the energy beam curable ink and thus to form an image and may be carried out by a curing unit.

Energy beam sources usable as the curing unit are those that emit energy beams such as ultraviolet light, and examples thereof include low pressure mercury lamps, high pressure mercury lamps, metal halide lamps, hot cathode tubes, cold cathode tubes, and light emitting diodes (LEDs). In ultraviolet (UV) irradiation lamps, there is a possibility that heat is generated and disadvantageously causes deformation of recording media. Accordingly, the UV irradiation lamps are preferably equipped with a cooling mechanism, for example, a cold mirror, a cold filter, or a work cooling structure.

The metal halide lamp is effective as a light source because the wavelength range is wide. Halides of metals such as lead (Pb), tin (Sn), and iron (Fe) are used as the metal halide, and the metal halide may be selected according to an absorption spectrum of the photoinitiator. Any lamp may be used without particular limitation as long as the lamp is effective for curing.

Figure 3A:
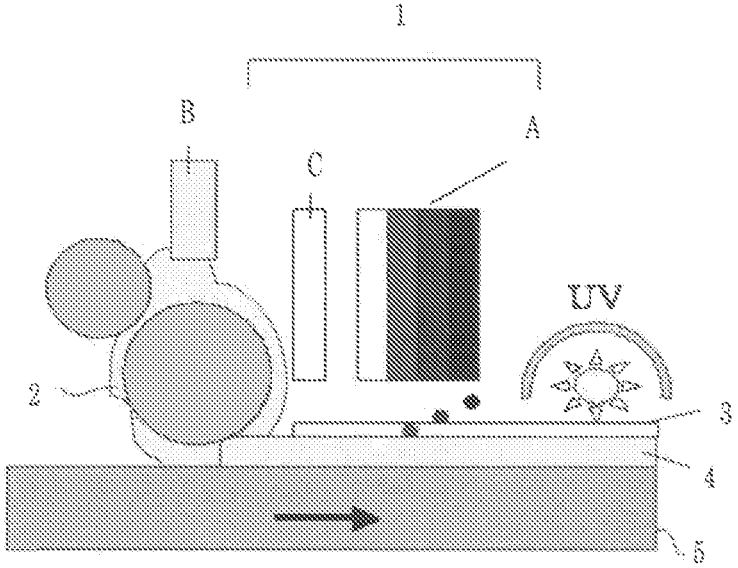
FIGS. 3A and 3B each are a schematic view used for explaining an exemplary ink jet recording apparatus.
Figure 3B:
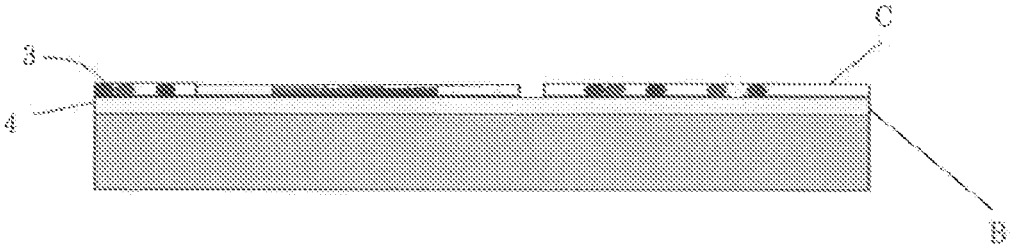

Here, the ink jet recording method can be performed by an ink jet recording apparatus as shown in FIGS. 3A and 3B, where reference numeral 1 denotes an ejection head, reference numeral 2 denotes an application roller, reference numeral 3 denotes an upper layer, reference numeral 4 denotes a lower layer and reference numeral 5 denotes paper, and reference character A denotes the ink A, reference character B denotes the liquid B and reference character C denotes the liquid C. If any, the same reference numerals or characters have the same meanings in FIGS. 4A and 4B, except that reference character C denotes the liquid C or a surfactant-containing liquid.

The ink jet recording apparatus shown in FIGS. 3A and 3B has a unit configured to apply the high-surface-tension energy beam curable liquid B, and a nozzle head capable of applying the low-surface-tension energy beam curable liquid C to the intended positions and of applying ink dots to the same positions.

The energy beam curable liquid B that is higher in viscosity and surface tension than the energy beam curable ink A is applied to a recording medium, and the low-surface-tension energy beam curable liquid C is dropped on the region where the energy beam curable liquid B has been applied. Then, the ink A is ejected on the energy beam curable liquid C for printing, followed by irradiating the printing portions with energy beams.

Figure 4A:
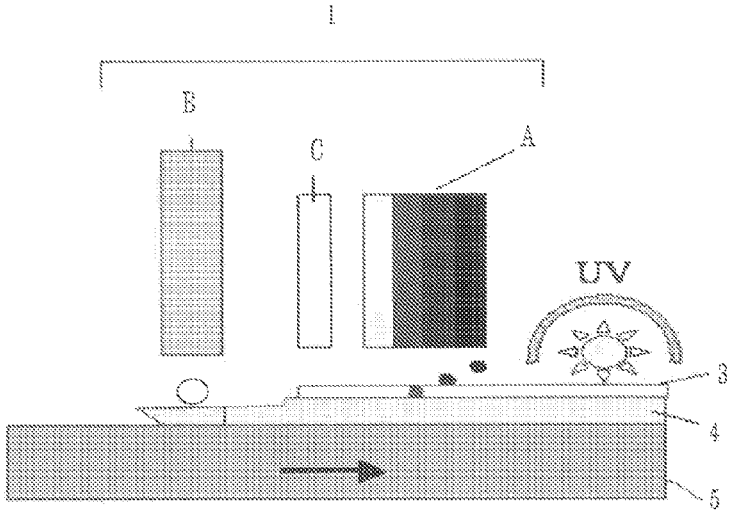
FIGS. 4A and 4B each are a schematic view used for explaining another exemplary ink jet recording apparatus.
Figure 4B:
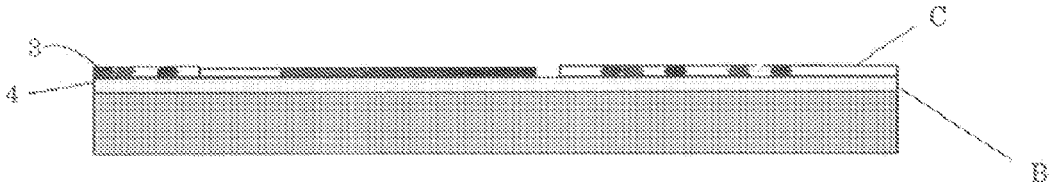

Also, as shown in FIGS. 4A and 4B, a high-surface-tension energy beam curable liquid B whose viscosity is to be higher than that upon ejection thereof is applied to a recording medium through an ink jet head; a surfactant-containing liquid or a low-surface-tension energy beam curable liquid C is applied to a part of the formed energy beam curable liquid B layer; and the energy beam curable ink A is ejected to the part for printing. The printing portions are irradiated with energy beams.

An ink jet recording apparatus shown in FIGS. 4A and 4B has a unit configured to apply the high-surface-tension energy beam curable liquid B, and a nozzle head capable of applying the surfactant-containing liquid or the low-surface-tension energy beam curable liquid C to the intended positions and of applying ink dots to the same positions.

In this case, the high-surface-tension energy beam curable liquid B used is a liquid whose viscosity is to be higher on the recording medium than that upon the ejection thereof.

Also, the high-surface-tension energy beam curable liquid B used is a liquid that is solidified at room temperature but is decreased in viscosity during heating to be able to be ejected through an ink jet head; e.g., an energy beam curable liquid containing wax.

Also, a liquid containing a gelling agent such as gelatin which gels at room temperature may be used as an aqueous high-surface-tension energy beam curable liquid B.

In addition, as shown in FIGS. 4A and 4B, there is performed an ink jet recording method including: a step of applying, through an ink jet head, a high-surface-tension energy beam curable liquid B whose viscosity is to be higher on a recording medium than that upon ejection thereof; dropping a surfactant-containing liquid on the other portion; ejecting an ink thereto; and applying energy beams thereto.

In this case, the high-surface-tension energy beam curable liquid B used is a liquid that is solidified at room temperature but is decreased in viscosity during heating to be able to be ejected through an ink jet head; e.g., an energy beam curable liquid containing wax.

Also, a liquid containing a gelling agent such as gelatin which gels at room temperature may be used as the high-surface-tension energy beam curable liquid B.

(Ink Jet Recorded Matter)

The ink jet recorded matter according to the present invention is formed by the ink jet recording method according to the present invention.

In the ink jet recorded matter, solid image portions and high-definition portions are different from each other in pixel dot size and the three-dimensional shape of dots.

EXAMPLES

Examples of the present invention will be described in more detail with reference to the accompanying drawing. However, it should be noted that the Examples are illustrative only and are not intended to limit the scope of the invention.

In order to confirm the effect of the present invention, ink dot images were formed and evaluated under the following conditions.

The static surface tension and viscosity of the energy beam curable liquid B having a high surface tension, the energy beam curable liquid C having a low surface tension, and the coloring matter-containing ink A used in the Examples were measured as follows.

<Measurement of Static Surface Tension>

The static surface tension was measured by the Wilhelmy method using AUTOMATIC SUPERFACE TENSIONMETER CBVP-Z (manufactured by Kyowa Interface Science Co., Ltd.). The Wilhelmy method is a method of measuring the surface tension of a liquid by reading the force with which the liquid pulls a probe (platinum plate) therein when the probe is in contact with the liquid. The measurement of the surface tension was carried out at 25° C.

<Measurement of Viscosity>

The viscosity was measured using rotary viscometer RE-80L (manufactured by TOKI SANGYO CO., LTD.) under the following measurement conditions.

[Measurement Conditions]

Rotor: 1°34'×R24

Sample amount: 1.2 mL, Measurement time: 3 min

Temperature: 25° C.

Rotation number: 50 rpm

<Preparation of Energy Beam Curable Liquid B Having High Surface Tension>

3% by mass of a reaction initiator (Irgacure 379 manufactured by BASF) was added to 97% by mass of a photocurable resin monomer (a caprolactane-modified dipentaerythritol hexaacrylate, KAYARAD DPCA60, manufactured by Nippon Kayaku Co., Ltd.) to prepare an energy beam curable liquid B having a high surface tension. The static surface tension and the viscosity (25° C.) of the energy beam curable liquid B having a high surface tension were 38 mN/m and 1,222 mPa·s, respectively.

<Preparation of Energy Beam Curable Liquid C Having Low Surface Tension>

10% by mass of a reaction initiator (Irgacure 379 manufactured by BASF) and 1% by mass of a surfactant (BYK3510 manufactured by BYK-Chemie) were added to a 3:7 (by mass) mixed liquid of a polymerizable compound (Viscoat V#1000 manufactured by Osaka Organic Chemical Industry Ltd.) and dioxolane acrylate (MEDOL10 manufactured by Osaka Organic Chemical Industry Ltd.) to prepare an energy beam curable liquid C having a low surface tension. The static surface tension and the viscosity (25° C.) of the energy beam curable liquid C having a low surface tension were 22 mN/m and 21.8 mPa·s, respectively.

—Coloring Matter-Containing Ink A—

A liquid having a static surface tension of 22 mN/m obtained by dispersing 3% by mass of carbon black (#5B, manufactured by Mitsubishi Chemical Corporation) in the energy beam curable liquid C having a low surface tension was used as a coloring matter-containing ink A. The viscosity (25° C.) of the coloring matter-containing ink A was 39.6 mPa·s.

Example 1

The energy beam curable liquid B having a high surface tension was coated on a 100 μm-thick polyethylene terephthalate (PET) film (Lumirror E20 manufactured by Toray Industries, Inc.) with a Select-Roller (OSP-02 manufactured by MATSUO SANGYO CO., LTD.) so that a thin layer having a thickness corresponding to 2 μm could be formed.

A printing apparatus using two Gen4 heads manufactured by Ricoh Printing Systems, Ltd. was provided, and the temperature and the waveform were regulated so that ink droplets could be ejected under conditions of 8 pL and 30 m/s. The energy beam curable liquid C having a low surface tension was ejected at 118 dot/cm (300 dpi) through a first head in the printing apparatus on a left half of a printing area on the energy beam curable liquid B layer having a high surface tension. Thereafter, the coloring matter-containing ink A was ejected at 118 dot/cm (300 dpi) through a second head in the printing apparatus on the whole printing area, followed by energy beam irradiation with a LTV irradiation system (Sub Zero 085 A Bulb manufactured by Integration Technology) under conditions that the illuminance at a wavelength of 365 nm was about 100 mJ/cm$^2$, to cure the energy beam curable liquid B layer having a high surface tension, the energy beam curable liquid C layer having a low surface tension, and the coloring matter-containing ink A and thus to form an image.

<Evaluation>

The image thus obtained was observed under a microscope to evaluate the image. The results are shown in FIG. 1 which is a magnified view of a microphotograph. In FIG. 1, reference character "A" denotes areas where the ink A was simultaneously ejected under the same conditions: printing conditions: 118 dot/cm (300 dpi) (8 pL) and conveying speed: 500 mm/s, reference character "B" denotes a coating area of the high surface tension liquid B, and reference character "C" denotes a dropping area of the low surface tension liquid C. It was found from the results shown in FIG. 1 that, when the energy beam curable ink A is ejected on the energy beam curable liquid B layer having a high surface tension, the energy beam curable ink A is instantaneously spread thinly on the energy beam curable liquid B layer having a high surface tension and, thus, a solid image can be effectively formed using a smaller amount of ink.

Further, it was also found from the results shown in FIG. 1 that, when the energy beam curable ink A is ejected on the energy beam curable liquid C layer having a low surface tension, ink droplets are partly or entirely permeated into the energy beam curable liquid C layer and energy beam irradiation in this state for curing can provide ink dots that have a smooth contour and a small diameter, that is, are suitable for high-definition images.

It was also found that, preferably, the three types of liquids have a static surface tension relationship of energy beam curable liquid C having low surface tension≤coloring matter-containing ink A<energy beam curable liquid B having high surface tension and the energy beam curable liquid B having a high surface tension has a static surface tension of 30 mN/m or more.

Also, a region where an image necessary for expression in light color tone is to be formed is preferably treated as follows. Specifically, an energy beam curable liquid C layer having a surface tension equal to or lower than the ink A is formed on a halftone image formed region, and the ink A is ejected on the energy beam curable liquid C.

This manner is suitable for beautifully expressing a halftone image whose dot density is not high, since it was found from the results shown in FIG. 1 that, when the energy beam curable ink A is ejected on the energy beam curable liquid C layer having a low surface tension, ink droplets are partly or entirely permeated into the energy beam curable liquid C layer and energy beam irradiation in this state for curing can provide ink dots that have a smooth contour and a small diameter.

Also, when a region where a solid image necessary for expression in dark color tone is to be formed is provided at its contour portion with an energy beam curable liquid C layer having a surface tension lower than the region where the solid image is to be formed, it is possible to form both a uniform, good solid portion and a smooth, clear contour, which can provide a high-quality image in a wider range.

From the results shown in FIG. 1, when the energy beam curable ink A is ejected on the energy beam curable liquid B layer having a high surface tension, the energy beam curable ink A is instantaneously spread thinly on the energy beam curable liquid B layer having a high surface tension and, thus, a solid image can be effectively formed using a smaller amount of ink. Therefore, the energy beam curable ink A is suitable for forming a solid image with less blank spots. However, each ink droplet spread broadly, so that the contour of the solid region is easily deformed and blurred to make it difficult to achieve definite expression.

Figure 2A:
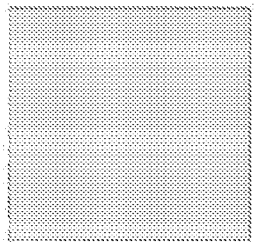
FIGS. 2A to 2D each are a view used for explaining the effect of patterned surface tensions.
Figure 2B:
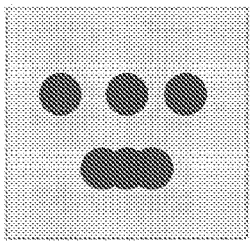
Figure 2C:
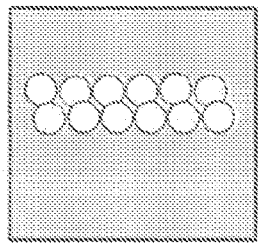
Figure 2D:
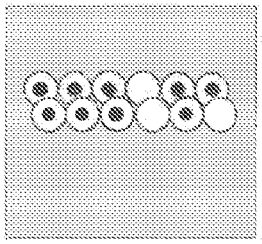
Figure 2E:
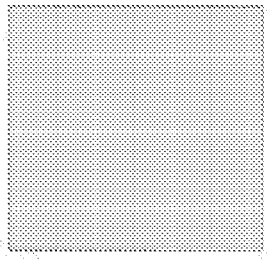
FIGS. 2E to 2H each are a view used for explaining a method of forming a clear contour and a solid image having no blank spots.
Figure 2F:
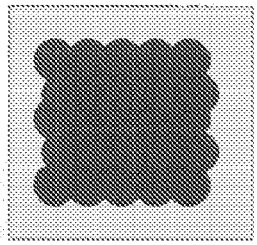
Figure 2G:
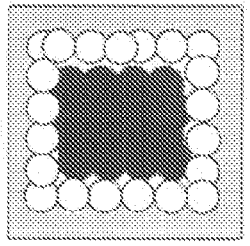
Figure 2H:
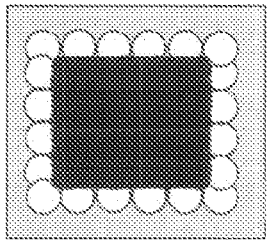

Thus, as shown in FIGS. 2A to 2H, the energy beam curable liquid C having a low surface tension was ejected to a region on the high-surface-tension energy beam curable liquid B layer, the region forming a contour portion of the solid image; and the energy beam curable ink A was ejected to the formed energy beam curable liquid C layer. Specifically, first, the high-surface-tension energy beam curable liquid B is applied to a recording medium (FIG. 2A). When the ink A is ejected on the formed liquid B layer, the ink A is spread to form dots each having a large diameter (FIG. 2B). Here, the low-surface-tension energy beam curable liquid C is ejected on the formed liquid B layer to form a low-surface-tension region (FIG. 2C). When the ink A is ejected on the low-surface-tension liquid C, dots each having a small diameter are formed (FIG. 2D). Similarly, first, the high-surface-tension energy beam curable liquid B is applied to a recording medium (FIG. 2E). When the ink A is ejected on the formed liquid B layer, the contour of the formed solid image is rough or deformed (FIG. 2F). Here, the low-surface-tension liquid C is ejected to the contour portion almost simultaneously with ejecting the ink A on the liquid B layer to form the solid image (FIG. 2G). In this manner, it is possible to form a clear contour and dots each having a small diameter (FIG. 2H). As a result, ink droplets are partly or entirely permeated into the energy beam curable liquid C layer and energy beam irradiation in this state for curing could form a good solid image having a smooth contour and having no blank spots, that is, suitable for high-definition images.

Example 2

FIGS. 5A to 5C, 6A to 6C and 7A to 7C each show evaluation results of the extent of ink bleeding in recording media different in ink absorption and wettability to ink.

Figure 5A:
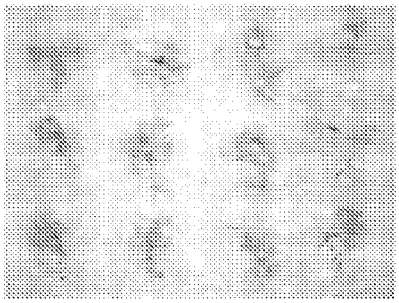
FIG. 5A is an image (objective lens: ×20) obtained when printing is directly performed on high-quality paper.
Figure 5B:
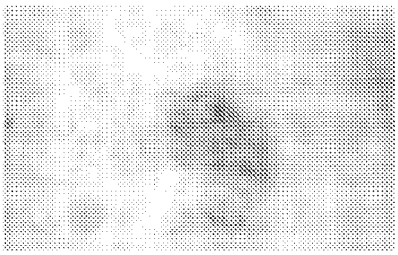
FIG. 5B is an image (objective lens: ×50) obtained when printing is directly performed on high-quality paper, with the peripheral PV being about 14 μm.
Figure 5C:
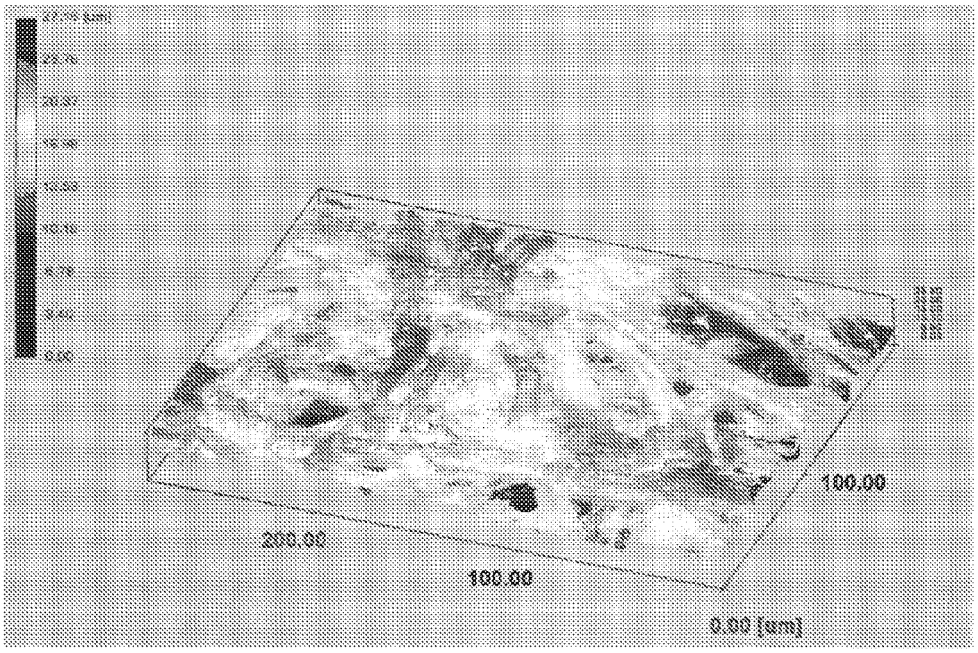
FIG. 5C is a 3D chart showing the height of each position when printing is directly performed on high-quality paper.
Figure 6A:
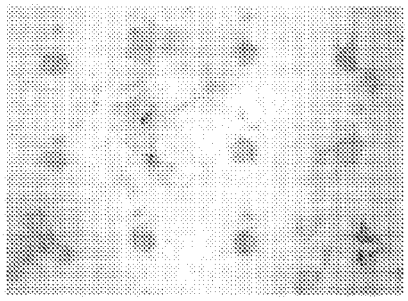
FIG. 6A is an image (objective lens: ×20) obtained when printing is performed on high-quality paper having one precoating thereon.
Figure 6B:
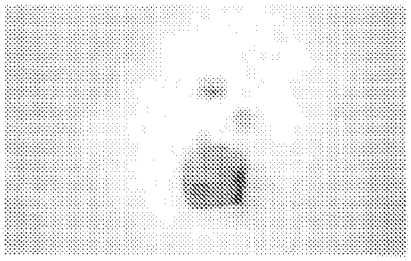
FIG. 6B is an image (objective lens: ×50) obtained when printing is performed on high-quality paper having one precoating thereon, with the peripheral PV being about 9 μm.
Figure 6C:
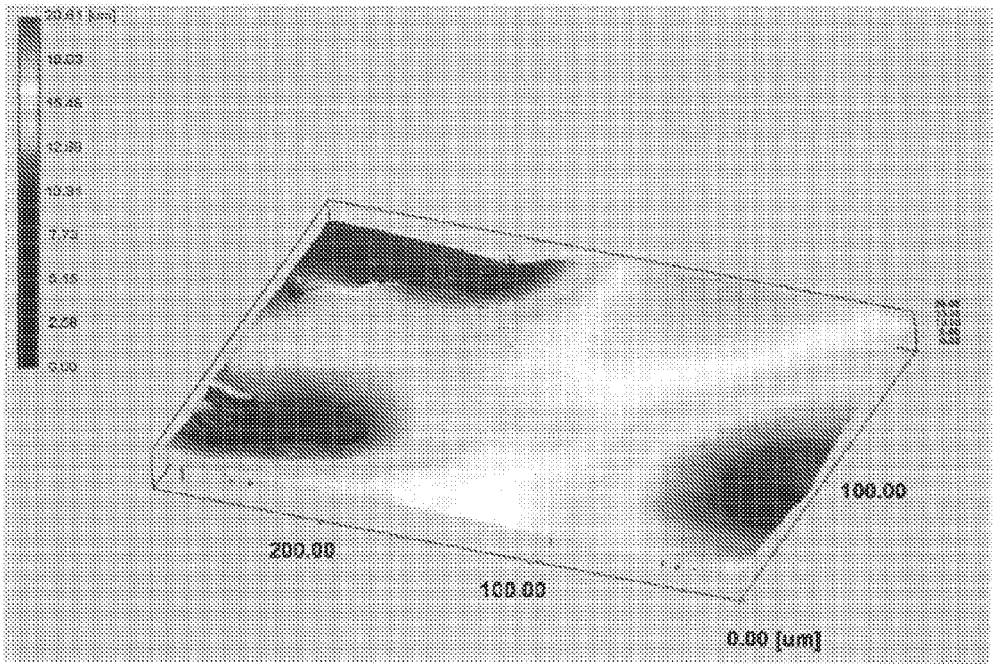
FIG. 6C is a 3D chart showing the height of each position when printing is performed on high-quality paper having one precoating thereon.
Figure 7A:
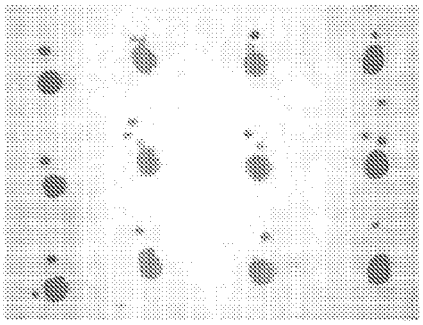
FIG. 7A is an image (objective lens: ×20) obtained when printing is performed on high-quality paper having two precoatings thereon.
Figure 7B:
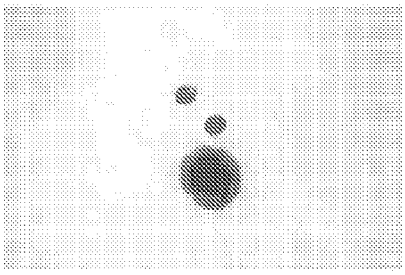
FIG. 7B is an image (objective lens: ×50) obtained when printing is performed on high-quality paper having two precoatings thereon, with the PV being 1.4 μm.
Figure 7C:
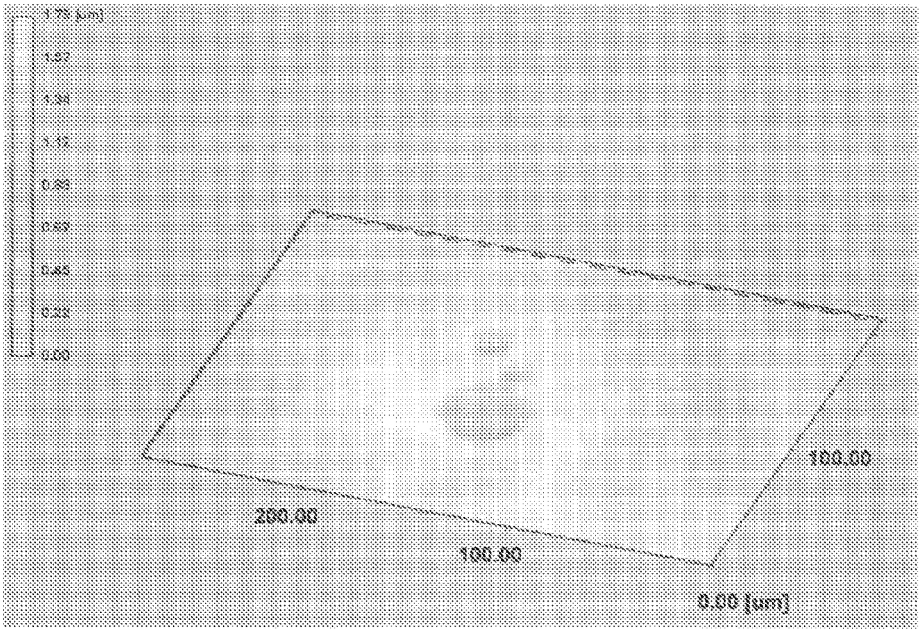
FIG. 7C is a 3D chart showing the height of each position when printing is performed on high-quality paper having two precoatings thereon.

FIGS. 5A to 5C each show evaluation results obtained when printing was directly performed on high-quality paper. FIGS. 6A to 6C each show evaluation results obtained when printing was performed on high-quality paper having one precoating thereon. FIGS. 7A to 7C each show evaluation results obtained when printing was performed on high-quality paper having two precoatings thereon. FIGS. 5A to 5C, 6A to 6C and 7A to 7C each were obtained using ULTRA-DEEP COLOR 3D PROFILE MEASURING MICROSCOPE VK-9500 (manufactured by KEYENCE CORPORATION).

The "peripheral PV" means the height difference between the dot and its surrounding area (concave and convex portions).

The high-quality paper used was MY PAPER (manufactured by Ricoh Company, Ltd.).

The one precoating was formed by applying, onto the high-quality paper, the same low-surface-tension energy beam curable liquid C as used in Example 1.

The two precoatings used were formed by applying, onto the high-quality paper, the same high-surface-tension energy beam curable liquid B as used in Example 1 and by applying the low-surface-tension energy beam curable liquid C onto the formed high-surface-tension energy beam curable liquid B layer.

From the results of FIGS. 5A to 5C, 6A to 6C and 7A to 7C, it was found that bleeding was considerable in directly printing on the high-quality paper. It was also found that the two precoatings could prevent the ink from permeating into the high-quality paper and thus form dots with less bleeding.

The embodiments of the present invention are as follows.

<1> An ink jet recording method including:

applying at least two energy beam curable liquids different from each other in surface tension on a recording medium to form an energy beam curable liquid layer having a distribution pattern of different surface tensions;

ejecting an energy beam curable ink on the energy beam curable liquid layer formed on the recording medium; and irradiating the energy beam curable liquid layer and the energy beam curable ink with energy beams to cure the energy beam curable liquid layer and the energy beam curable ink to form an image.

<2> The ink jet recording method according to <1>, wherein the distribution pattern of the energy beam curable liquid layer includes: a high surface tension region formed of the energy beam curable liquid is having a surface tension higher than the energy beam curable ink; and a low surface tension region formed of the energy beam curing liquid having a surface tension equal to or lower than the energy beam curable ink.

<3> The ink jet recording method according to <2>, wherein the ejection includes ejecting the energy beam curable ink onto the low surface tension region to form a high resolution expression image formed region.

<4> The ink jet recording method according to <2>, wherein the ejecting includes ejecting the energy beam curable ink on the low surface tension region to form a halftone image formed region.

<5> The ink jet recording method according to <2>, wherein the ejecting includes ejecting the energy beam curable ink on the high surface tension region to form a solid image formed region.

<6> The ink jet recording method according to <5>, further including forming an energy beam curable liquid layer having a surface tension lower than the solid image formed region on a contour portion of the solid image formed region.

<7> The ink jet recording method according to <1>, wherein the applying includes:

applying, onto the recording medium, the energy beam curable liquid having a surface tension higher than the energy beam curable ink, to thereby form the energy beam curable liquid layer having a high surface tension; and forming the energy beam curable liquid layer having a surface tension lower than the energy beam curable ink on at least a part of the formed energy beam curable liquid layer having a high surface tension.

<8> The ink jet recording method according to <1>, wherein the applying includes:

applying, onto the recording medium, the energy beam curable liquid having a surface tension higher than the energy beam curable ink, to thereby form the energy beam curable liquid layer having a high surface tension; and applying a surfactant-containing liquid on the formed energy beam curable liquid layer having a high surface tension to form a surfactant-containing liquid layer.

<9> The ink jet recording method according to <1>, wherein the applying includes:

applying, onto the recording medium, the energy beam curable liquid having a viscosity and a surface tension that are higher than the energy beam curable ink, to thereby form the energy beam curable liquid layer having a high surface tension; and applying a surfactant-containing liquid on the formed energy beam curable liquid layer having a high surface tension to form a surfactant-containing liquid layer.

<10> The ink jet recording method according to <1>, wherein the applying includes:

ejecting, onto the recording medium through an ink jet head, the energy beam curable liquid which has a high surface tension and whose viscosity is to be higher than that upon the ejecting, to thereby form the energy beam curable liquid layer having a high surface tension; and applying a surfactant-containing liquid on at least a part of the formed energy beam curable liquid layer having a high surface tension to form a surfactant-containing liquid layer.

<11> The ink jet recording method according to <1>, wherein the applying includes:

ejecting, onto the recording medium through an ink jet head, the energy beam curable liquid which has a high surface tension and whose viscosity is to be higher than that upon the ejecting, to thereby form the energy beam curable liquid layer having a high surface tension; and applying a surfactant-containing liquid on a part other than the formed energy beam curable liquid layer having a high surface tension to form a surfactant-containing liquid layer.

<12> An ink jet recording apparatus including:

an energy beam curable liquid layer formation unit configured to apply at least two energy beam curable liquids different from each other in surface tension on a recording medium to form an energy beam curable liquid layer having a distribution pattern of different surface tensions;

an ink ejection unit configured to eject an energy beam curable ink on the energy beam curable liquid layer formed on the recording medium; and a curing unit configured to irradiate the energy beam curable liquid layer and the energy beam curable ink with energy beams to cure the energy beam curable liquid layer and the energy beam curable ink to form an image.

<13> The ink jet recording apparatus according to <12>, wherein the ink ejection unit includes a nozzle head.

<14> An ink jet recorded matter including:

a recording medium; and an image formed on the recording medium by the ink jet recording method according to any one of <1> to <11>.

This application claims priority to Japanese application No. 2011-067081, filed on Mar. 25, 2011, and incorporated herein by reference.

What is claimed is:

1. An ink jet recording method comprising:

applying at least two energy beam curable liquids different from each other in surface tension on a recording medium to form an energy beam curable liquid layer having a distribution pattern of different surface tensions, wherein the distribution pattern of the energy beam curable liquid layer comprises: a high surface tension region formed of the energy beam curable liquid having a surface tension higher than the energy beam curable ink; and a low surface tension region formed of the energy beam curing liquid having a surface tension equal to or lower than the energy beam curable ink;

ejecting an energy beam curable ink on the energy beam curable liquid layer formed on the recording medium; and irradiating the energy beam curable liquid layer and the energy beam curable ink with energy beams to cure the energy beam curable liquid layer and the energy beam curable ink to form an image.

2. The ink jet recording method according to claim 1, wherein the ejection comprises ejecting the energy beam curable ink onto the low surface tension region to form a high resolution expression image formed region.

3. The ink jet recording method according to claim 1, wherein the ejecting comprises ejecting the energy beam curable ink on the low surface tension region to form a halftone image formed region.

4. The ink jet recording method according to claim 1, wherein the ejecting comprises ejecting the energy beam curable ink on the high surface tension region to form a solid image formed region.

5. The ink jet recording method according to claim 4, further comprising forming an energy beam curable liquid layer having a surface tension lower than the solid image formed region on a contour portion of the solid image formed region.

6. The ink jet recording method according to claim 1, wherein the applying comprises:

applying, onto the recording medium, the energy beam curable liquid having a surface tension higher than the energy beam curable ink, to thereby form the energy beam curable liquid layer having a high surface tension; and forming the energy beam curable liquid layer having a surface tension lower than the energy beam curable ink on at least a part of the formed energy beam curable liquid layer having a high surface tension.

7. The ink jet recording method according to claim 1, wherein the applying comprises:

applying, onto the recording medium, the energy beam curable liquid having a surface tension higher than the energy beam curable ink, to thereby form the energy beam curable liquid layer having a high surface tension; and applying a surfactant-containing liquid on the formed energy beam curable liquid layer having a high surface tension to form a surfactant-containing liquid layer.

8. The ink jet recording method according to claim 1, wherein the applying comprises:

applying, onto the recording medium, the energy beam curable liquid having a viscosity and a surface tension that are higher than the energy beam curable ink, to thereby form the energy beam curable liquid layer having a high surface tension; and applying a surfactant-containing liquid on the formed energy beam curable liquid layer having a high surface tension to form a surfactant-containing liquid layer.

9. The ink jet recording method according to claim 1, wherein the applying comprises:

ejecting, onto the recording medium through an ink jet head, the energy beam curable liquid which has a high surface tension and whose viscosity is to be higher than that upon the ejecting, to thereby form the energy beam curable liquid layer having a high surface tension; and applying a surfactant-containing liquid on at least a part of the formed energy beam curable liquid layer having a high surface tension to form a surfactant-containing liquid layer.

10. The ink jet recording method according to claim 1, wherein the applying comprises:

ejecting, onto the recording medium through an ink jet head, the energy beam curable liquid which has a high surface tension and whose viscosity is to be higher than that upon the ejecting, to thereby form the energy beam curable liquid layer having a high surface tension; and applying a surfactant-containing liquid on a part other than the formed energy beam curable liquid layer having a high surface tension to form a surfactant-containing liquid layer.

11. An ink jet recording apparatus comprising:

an energy beam curable liquid layer formation unit configured to apply at least two energy beam curable liquids different from each other in surface tension on a recording medium to form an energy beam curable liquid layer having a distribution pattern of different surface tensions, wherein the distribution pattern of the energy beam curable liquid layer comprises: a high surface tension region formed of the energy beam curable liquid having a surface tension higher than the energy beam curable ink; and a low surface tension region formed of the energy beam curing liquid having a surface tension equal to or lower than the energy beam curable ink;

an ink ejection unit configured to eject an energy beam curable ink on the energy beam curable liquid layer formed on the recording medium; and a curing unit configured to irradiate the energy beam curable liquid layer and the energy beam curable ink with energy beams to cure the energy beam curable liquid layer and the energy beam curable ink to form an image.

12. The ink jet recording apparatus according to claim 11, wherein the ink ejection unit comprises a nozzle head.

13. An ink jet recorded matter comprising:

a recording medium; and an image formed on the recording medium by an ink jet recording method which comprises:

applying at least two energy beam curable liquids different from each other in surface tension on the recording medium to form an energy beam curable liquid layer having a distribution pattern of different surface tensions, wherein the distribution pattern of the energy beam curable liquid layer comprises: a high surface tension region formed of the energy beam curable liquid having a surface tension higher than the energy beam curable ink; and a low surface tension region formed of the energy beam curing liquid having a surface tension equal to or lower than the energy beam curable ink;

ejecting an energy beam curable ink on the energy beam curable liquid layer formed on the recording medium; and irradiating the energy beam curable liquid layer and the energy beam curable ink with energy beams to cure the energy beam curable liquid layer and the energy beam curable ink to form the image.

* * * * *

UNITED STATES PATENT AND TRADEMARK OFFICE

CERTIFICATE OF CORRECTION

PATENT NO. : 8,740,374 B2
APPLICATION NO. : 13/427174
DATED : June 3, 2014
INVENTOR(S) : Seno et al.

It is certified that error appears in the above-identified patent and that said Letters Patent is hereby corrected as shown below:

On the title page, Item [75], the 5th Inventor should read:

--Noriyasu Takeuchi, Kanagawa (JP);--

Signed and Sealed this
Seventh Day of October, 2014

Michelle K. Lee

Michelle K. Lee
*Deputy Director of the United States Patent and Trademark Office*